United States Patent [19]

Hicks, Sr.

[11] Patent Number: 4,567,735

[45] Date of Patent: Feb. 4, 1986

[54] COLUMN TYPE EVAPORATOR FOR ICE MACHINES

[75] Inventor: James L. Hicks, Sr., Gilmer, Tex.

[73] Assignee: Kold-Serve Corporation, Longview, Tex.

[21] Appl. No.: 609,987

[22] Filed: May 14, 1984

[51] Int. Cl.[4] ..... F25C 1/12

[52] U.S. Cl. ..... 62/347; 62/277

[58] Field of Search ..... 62/347, 352, 348, 277

[56] References Cited

U.S. PATENT DOCUMENTS

| | | | |
|---|---|---|---|
| Re. 26,693 | 10/1969 | Campbell | 62/352 |
| 3,146,610 | 9/1964 | Lowe | 62/347 |
| 3,206,945 | 9/1965 | Nilsson et al. | 62/352 |
| 3,435,633 | 4/1969 | Dixon | 62/347 |
| 3,769,812 | 11/1973 | Gordon | 62/352 |
| 4,295,340 | 10/1981 | Abraham | 62/277 X |

*Primary Examiner*—William E. Tapolcai

*Attorney, Agent, or Firm*—Lowe, King, Price & Becker

[57] ABSTRACT

A vertical column type evaporator for ice manufacture formed of inner and outer tubular members defining an evporation chamber has separate refrigerant and hot gas lines extending into the bottom region of the evaporator and has a suction line at the top region. A conduit connecting a discharge of a compressor to an expansion valve leading to the refrigerant line is wrapped around an upper exterior end of an outer tubular member of the chamber. The upper end of the chamber is thereby preheated by compressed refrigerant in the conduit wrap so that ice formed along upper wall portions in the evaporator chamber is rapidly released during the ice harvesting cycle.

6 Claims, 5 Drawing Figures

COLUMN TYPE EVAPORATOR FOR ICE MACHINES

TECHNICAL FIELD

The present invention relates to ice manufacturing machines in general, and in particular, to improvements in column type evaporators for such machines.

BACKGROUND ART

Previously, methods and apparatus have been developed for harvesting ice from column type evaporators in which a gas such as Freon is utilized as a refrigerant. The gas, after passing through a heat exchanger and compressor, enters a chamber formed between two concentric tubular members. This chamber is sealed at both ends, thus forcing the refrigerant gas to enter or exit the chamber only at two designated locations. Simultaneously as the gas is discharged into the chamber and while expanding therein, water is introduced to flow along the outer exposed surfaces of the concentric tubular members and transformed into ice due to the heat absorption from the concentric tubular members occasioned by the expansion of the refrigerant gas. After the water is transformed into ice, the gas that has become a non-refrigerant through heat absorption is recirculated between the tubular members. This warms the surfaces of the tubular members and eventually enables the ice to be removed. In previously known evaporators of the vertical column type, the tubular members tend to cool excessively at the regions nearest the discharge of the refrigerant from the cold gas or refrigerant inlet. A relatively large temperature differential may occur on the surfaces of the tubular members, causing the formation of uneven ice thicknesses during the freezing cycle. Consequently, the ice becomes difficult to remove from the evaporator.

To avoid this problem, an improved column type evaporator, disclosed in U.S. Re. Pat. No. 26,693 to Paul D. Campbell, reissued Oct. 14, 1969, utilizes separate refrigerant and hot gas lines, extending through the evaporator chamber and terminating adjacent each other at a lower region of the chamber. A gas deflection element connected to the hot gas line is in the form of an annular ring disposed to cause hot gas to flow toward the discharge end of the refrigerant line. The hot gas thus preheats the discharge end of the refrigerant line. During the freezing cycle, rapid expansion of the refrigerant as it leaves the discharge end of the refrigerant line is moderated to obtain more uniform ice thickness throughout the length of the evaporator.

While the aforesaid evaporator is generally more efficient than other evaporators of which I am aware, ice formed at the upper part of the evaporator chamber requires a substantial period of time to release from and slide off the outer and inner tubular members since the hot gas entering the chamber from the bottom has given up most of its latent heat prior to reaching the upper part of the chamber. Thus, a relatively long ice harvest cycle is required, and the power requirements of the evaporator is also relatively high.

During the freezing cycle, another disadvantage associated with the above evaporator is that of ice bridging to a top plate connecting upper ends of the inner and outer tubular members together. This ice bridging problem also occurs along the upper walls of the tubular members where water is initially sprayed, resulting in a formation of ice having an uneven thickness within the upper region of the evaporator.

It is accordingly an object of the present invention to provide an improved column type evaporator for ice manufacturing machines.

Another object of the present invention is to improve the ice harvest cycle in a column type evaporator by preheating upper parts of the inner and outer tubular members so that ice releases from and slides off the members relatively quickly during the harvest cycle.

Still another object is to provide an improved column type evaporator wherein ice bridging to the top plate in connecting the tubular members as well as ice bridging along the upper surfaces of the tubular members is prevented to encourage formation of an ice layer of a uniform thickness.

Yet a further object of the invention is to increase ice production by reducing both freezing and ice harvesting cycle times, thereby conserving power.

Still another object of the invention is to achieve the foregoing objects without requiring additional parts or equipment.

SUMMARY OF THE INVENTION

A vertical column evaporator for ice manufacturing machines, in accordance with the present invention, comprises outer and inner tubular members concentrically mounted to define an elongated and sealed annular evaporator chamber. A refrigerant line extends from an expansion valve and passes through the evaporator chamber with a discharge end portion terminating in a lower region thereof. Refrigerant or cold gas is supplied to the refrigerant line by a conduit connecting the valve to a compressor. A hot gas line also extends through the evaporator chamber with an end portion terminating at a region of the chamber adjacent the discharge end of the refrigerant line. According to the invention the improvement comprises forming the conduit extending between the compressor and expansion valve with a coiled portion in thermal contact with an upper exterior surface of the outer tubular member. Preheating of this upper region permits ice formed along upper surfaces of the outer and inner tubular members during the freezing cycle to quickly release from the tubular members to shorten the ice harvesting cycle.

In accordance with another aspect of the invention, the preheating coil is sized to maintain the temperature of the upper region of both the inner and outer tubular members at a temperature above freezing. The coil is wrapped around a predetermined length of the outer tube upper surface located above the spray nozzle and between a top connecting plate, for maximum efficiency.

A method for improving the ice making efficiency of a vertical column evaporator for ice manufacturing machines is also disclosed. In accordance with the method of the invention, a refrigerant fluid is compressed. An upper exterior surface of an outer tubular member of the evaporator is then preheated by directing the compressed refrigerant into thermal contact with the upper surface, causing latent heat within the compressed fluid to flow by conduction into an upper end of the outer member. The compressed refrigerant is then expanded and directed into a sealed evaporator. The refrigerant is discharged into a lower region of the chamber while water is simultaneously sprayed onto side walls of tubular members. The refrigerant flowing upwardly through the chamber causes the water to be transformed into ice. The ice is harvested by charging the chamber with hot gas transmitted into the bottom region of the chamber. The hot gas flows upwardly through the chamber to raise the temperature of the tubular members causing ice to slip therefrom. Preheating of the upper end thus allows the hot gas to release ice from the upper end of the tubular members in substantially the same time interval as ice formed along lower portions of the tubular members is released.

In accordance with another feature of the invention, preheating of the outer tubular member preferably occurs along the upper 1 to 1½ inches thereof. Furthermore, such preheating preferably occurs at an upper end region located immediately above side walls of the tubular members on which water is sprayed.

Still other objects and advantages of the present invention will become readily apparent to those skilled in this art from the following detailed description, wherein I have shown and described on the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 2:
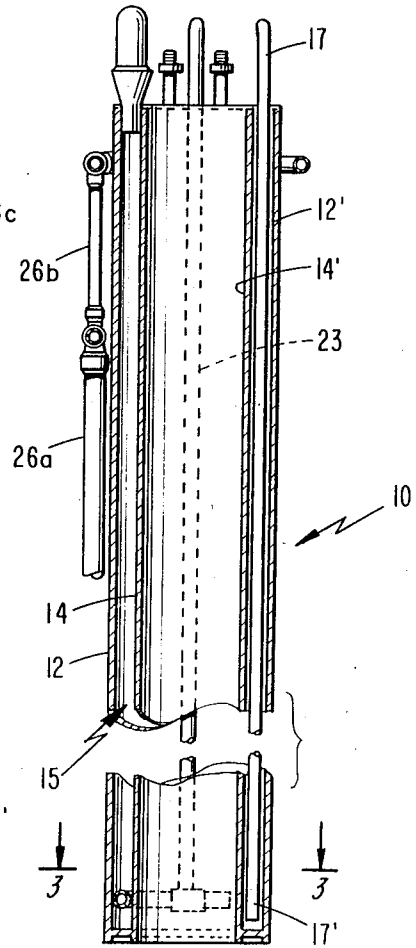
FIG. 2 (PRIOR ART)
FIG. 2 is a sectional view of the prior art evaporator shown in FIG. 1.
Figure 1:
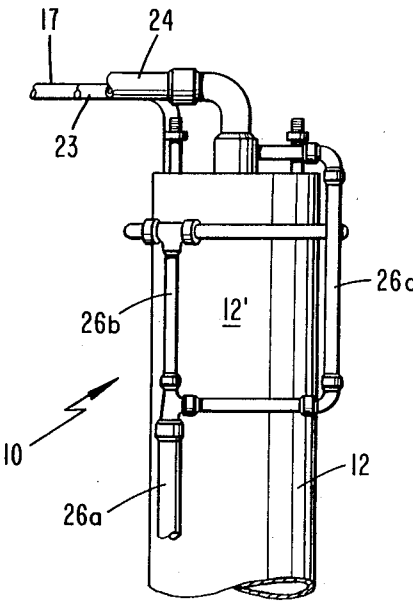
FIG. 1 (PRIOR ART)
FIG. 1 is a partial elevational view of a prior art column evaporator.
Figure 3:
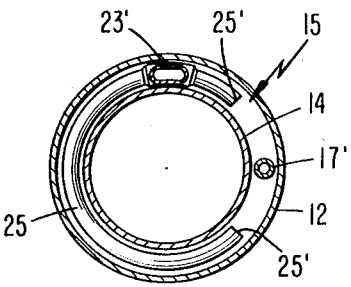
FIG. 3 (PRIOR ART)
FIG. 3 is a cross sectional view of the evaporator of FIGS. 1 and 2 taken along line 3—3 of FIG. 2.

Referring to FIGS. 1-3, a prior art vertical column type evaporator for ice manufacturing machines over which the present invention is an improvement is first described. This prior art evaporator is disclosed in U.S. Re. Pat. No. 26,693 to Campbell, reissued Oct. 14, 1969, incorporated by reference herein in its entirety.

Evaporator 10 comprises an outer tubular member 12 and a concentric, inner tubular member 14, together defining an elongated and sealed annular evaporator chamber 15. A cold gas or refrigerant line 17 extends from a compressor (not shown) and expansion valve (not shown) through evaporator chamber 15 and terminates at a lower region of the evaporator at discharge end 17' as shown in FIG. 3. A hot gas line 23 also extends through chamber 15, with an end portion 23' terminating at a region of the chamber adjacent discharge end 17' of refrigerant line 17. A gas outlet 24 is provided to enable recycling of the gas through the refrigerant system (not shown in detail).

Spray means (not shown) disclosed in U.S. Re. Pat. No. 26,693 occasionally discharges water supplied through pipes *26a, 26b* and *26c* onto the exterior surface 12' of outer tubular member 12 as well as onto the interior surface 14' of inner tubular member 14. This water is eventually transformed into ice as described below.

Disposed on hot gas inlet 23' is a deflection element 25 utilized to direct hot gas against opposite sides of discharge end portion 17' of cold gas or refrigerant line 17. Gas deflection element 25 is an annular ring having a removed section to define two substantially opposing ends 25' through which hot gas flows. (See FIG. 3).

During the freezing cycle, compressed refrigerant is introduced into evaporator chamber 15 through cold gas inlet 17. As the cold gas exits from discharge end 17', it expands into the evaporator chamber with a resulting reduction of temperature that cools both inner and outer tubular members 12, 14. Simultaneously, and prefer ably by automatic means such as solenoid valves (not shown), water is sprayed onto surfaces 12', 14' of tubular members 12, 14. Since the spray means is disposed at the upper end of the tubular members, water flows down the surfaces thereof and is transformed into ice while the members are cooled by expansion of a refrigerant passing through chamber 15

After ice of a predetermined thickness has formed, the flow of both cold refrigerant and water is stopped by, e.g., solenoid valves, while a third hot gas is controlled to enter the evaporator chamber through hot gas inlet 23, initiating the ice harvest cycle. Preferably, this hot gas is the Freon used as the refrigerant gas during the freezing cycle but which became warm during expansion through the evaporator chamber. Thus, the hot gas obtained upstream of the heat exchanger (not shown) in the refrigeration system is distributed through the hot gas inlet to the gas deflector 25. The flow of hot gas upward through the evaporator chamber and ultimately through the hot gas outlet 24 raises the temperature of the inner and outer tubular members, ultimately causing the ice to release.

As discussed above, the flow of hot gas upward through chamber 15 causes the gas to lose most of its latent heat and thereby release ice from lower and intermediate regions of tubular members 12, 14. Thus, by the time the hot gas reaches the upper end of members 12, 14 in chamber 15, insufficient latent heat remains within the gas to release ice surrounding the upper end of the chamber in the same time interval as ice is released from lower and intermediate portions of the members 12, 14. A longer ice harvest cycle time is accordingly required to completely release ice from all portions of the tubular members surrounding chamber 15, thereby decreasing ice production.

Figure 4:
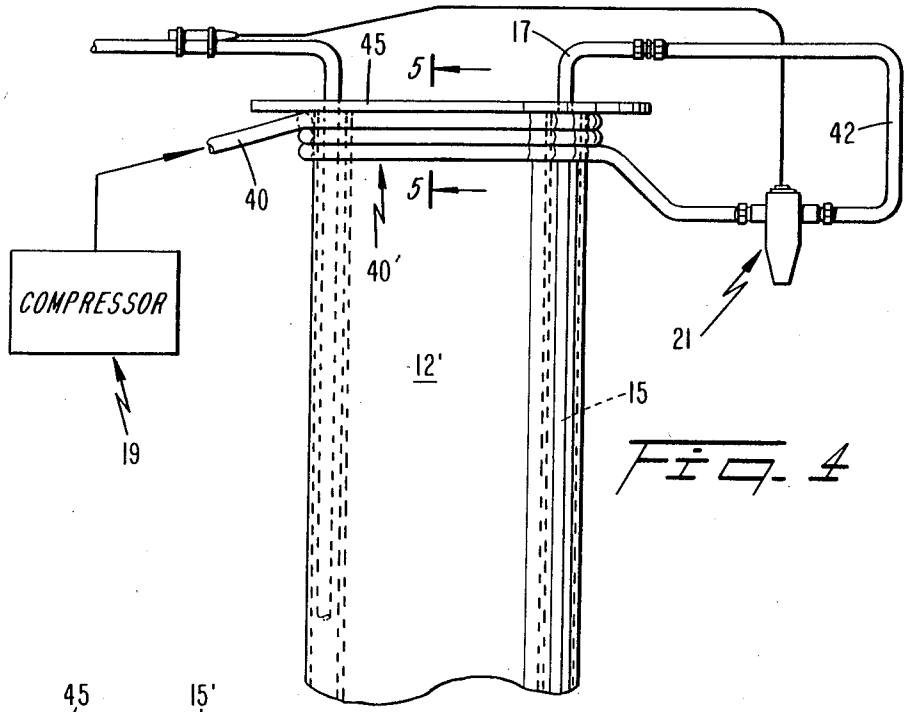
FIG. 4 is a partial elevational view of the column evaporator of FIG. 1 embodying the improvement of the present invention.
Figure 5:
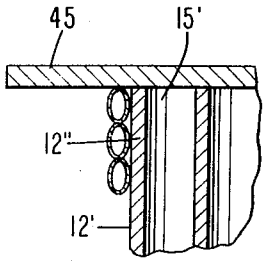
FIG. 5 is a sectional view taken along the line 5—5 in FIG. 4 showing a conduit wound in thermal contact with an upper exterior surface of an outer tubular member of the column evaporator.

Reference is now made to FIGS. 4 and 5, wherein an improvement to evaporator 10 is shown for minimizing the duration of the ice harvest cycle. A section 40' of a conduit 40 connecting the discharge of compressor 19 to expansion valve 21 is wrapped around and in thermal contact with an upper end 12'' of outer tubular member exterior surface 12'. Heat transfer coil 40', preferably ovaloid in cross section for improved thermal contact with upper end 12'', receives hot, compressed refrigerant fluid discharged from compressor 19. As hot liquid circulates through coil 40', it gives up heat to the tubular walls of the coil which is then transferred by conduction to upper end 12'' of outer tubular member 12. Hot liquid in conduit 40 is metered through expansion valve 21 and thereafter passes through a conduit 42 into refrigerant line 17 where it enters chamber 15 as a cold gas through discharge end 17' in the manner described above.

Heat transfer coil 40' provides significant advantages in improving ice production efficiency of evaporator 10. As one advantage, the ice harvest time is significantly decreased. By preheating upper end 12" and thereby upper region 15' of chamber 15 until the temperature in the upper ends is above freezing, the heating ability of hot gas circulating upward through chamber 15 during the harvest cycle is improved so that ice formed immediately below the upper end quickly slides off the inner and outer tubular members is substantially the same time interval as ice formed along the lower and intermediate portions of the tubular members is harvested. Such preheating also prevents water, sprayed just below heat transfer coil 40', from freezing or bridging to top plate 45 to which inner and outer tubular members 12, 14 are silver braised. Furthermore, since some of the heat in the liquid refrigerant is transferred to upper end 12" prior to metering of the liquid into expansion valve 21, a colder refrigerant gas is ultimately discharged into evaporator chamber 15, thereby shortening the ice freezing cycle. Thus, heat transfer coil 40' in the aforesaid configuration enables evaporator 10 to produce more ice utilizing the same power specifications of the evaporator disclosed in U.S. Re. Pat. No. 26,693.

Preferably, heat transfer coil 40' is wrapped to cover the upper 1 to 1½ inches of the exterior surface of outer tubular member 12. For controlled heat transfer, the wall thickness of coil 40' is approximately ⅛ inch with a diameter ranging from ¼ to 5/16 inch depending upon the size of compressor 19, the diameter of evaporator 10, i.e., the diameters of inner and outer tubular members 12, 14, the length of evaporator 10 and the flow rate of water sprayed onto surfaces of the tubular members. Generally, however, heat transfer from coil 40' to evaporator 10 is engineered to utilize the latent heat of refrigerant to produce the benefits of its head load to obtain a temperature within upper end 15' that is slightly above freezing (i.e., so that ice does not form on portions of members 12, 14 adjacent the coil).

In one practical embodiment of the invention, five of evaporators 10 connected in series to a 10 horsepower compressor together produced 5000 lbs. of ice per 24 hours during continuous operation, with the following specifications:

inner tubular member—5" I.D., 36" length
outer tubular member—6" I.D., 36" length
wall thickness of heat transfer coil—⅛"
diameter of heat transfer coil—5/16" wrapped to cover the upper 1½ inches of the outer tubular member
flow rate of water—10 gallons flow per hour
suction pressure—operational 28 down to 15 lbs. at harvest In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. In an ice making machine including a compressor, an expansion valve and a conduit interconnecting said compressor and said expansion valve, and a vertical column evaporator, said evaporator including an outer tubular member, an inner tubular member within and substantially coextensive with said outer tubular member, corresponding ends of said inner and outer tubular members being enclosed, an annular, sealed evaporator chamber thereby being established between said tubular members, a refrigerant line extending from the expansion valve to which refrigerant or cold gas is supplied by the conduit, said refrigerant line extending through said evaporator chamber and terminating in a lower region of the chamber, and a hot gas line extending through said evaporator chamber and terminating at a region of said chamber adjacent said refrigerant line;

the improvement wherein a section of said conduit is wrapped around and in thermal contact with an upper portion of said evaporator chamber, whereby compressed fluid within said coiled portion conducts latent heat to said upper portion of said evaporator chamber, said coiled portion being located above a spray nozzle used to spray water on one of said tubular members resulting in ice formation.

2. The evaporator of claim 1, wherein said conduit section is wrapped around and in thermal contact with an upper exterior surface of said outer tubular member.

3. The evaporator of claim 2, wherein said conduit section includes a plurality of coils wrapped around said upper exterior surface.

4. A method of improving the efficiency of ice manufacturing machines having a vertical column evaporator, including an evaporator formed on inner and outer tubular members, comprising the steps of:

(a) compressing a refrigerant fluid;
(b) preheating an upper exterior surface of the outer tubular member by directing compressed refrigerant leaving the compressor in thermal contact with said upper exterior surface, causing latent heat within the compressed fluid to flow by conduction into an upper end of the outer member;
(c) expanding the compressed refrigerant fluid;
(d) directing expanded refrigerant into the evaporator chamber;
(e) discharging refrigerant into a lower region of said chamber while simultaneously spraying with water side walls of the outer and inner tubular members, said refrigerant flowing through the chamber causing the water to be transformed into ice; and
(f) harvesting the ice from the chamber sidewalls by charging the chamber with a hot gas from a lower region of the chamber, said hot gas flowing upward through the chamber to raise the temperature of the tubular members to release ice therefrom;

said preheating of the upper end of the outer member occurring above a spray nozzle used to spray the water on said side walls, said preheating allowing the hot gas to release ice from the upper end of the tubular members in substantially the same time interval as ice formed along lower portions of the tubular members is released by the hot gas.

5. The method of claim 4, wherein preheating of the upper exterior surface occurs only within an upper end portion of approximately 1 to 1½ inches in length of the outer tubular member.

6. In an ice making machine including a compressor, an expansion valve and a conduit interconnecting said compressor and said expansion valve, and a vertical column evaporator, said evaporator including an outer tubular member, an inner tubular member within and substantially coextensive with said outer tubular member, corresponding ends of said inner and outer tubular members being enclosed to establish an annular sealed evaporator chamber therebetween, a refrigerant line extending from the expansion valve to which refrigerant or cold gas is supplied by the conduit, said refrigerant line extending through said evaporator chamber and terminating in an end region of the chamber, and a hot gas line extending through said evaporator chamber and terminating at a region of said chamber adjacent said refrigerant line;

the improvement wherein a section of said conduit is wrapped around and in thermal contact with an exterior surface of said outer tubular member located at one end of said outer tubular member remote from an inlet of said refrigerant line supplying cold gas or refrigerant to the chamber and wherein said wrapped conduit is located above a spray nozzle used to spray water on one of said tubular members resulting in ice formation.

* * * * *